United States Patent [19]

Evans et al.

[11] Patent Number: 4,570,353

[45] Date of Patent: Feb. 18, 1986

[54] MAGNETIC SINGLE SHOT INCLINOMETER

[75] Inventors: John L. Evans; Larry R. Russell, both of Houston, Tex.

[73] Assignee: Exxon Production Research Co., Houston, Tex.

[21] Appl. No.: 687,602

[22] Filed: Dec. 31, 1984

[51] Int. Cl.[4] ..... E21B 47/022

[52] U.S. Cl. ..... 33/313; 33/304; 33/308; 33/318

[58] Field of Search ..... 33/313, 304, 308, 310, 33/318, 319, 402, 397, 324; 73/1 E, 151

[56] References Cited

U.S. PATENT DOCUMENTS

| | | | |
|---|---|---|---|
| 1,786,184 | 12/1930 | Woodmansee | 33/313 |
| 1,803,785 | 5/1931 | Abler | 33/310 |
| 2,313,168 | 3/1943 | Opocensky | 33/313 |
| 2,648,141 | 8/1953 | Hildebrandt | 33/304 |
| 2,770,887 | 11/1956 | Barnett et al. | 33/313 |
| 2,829,443 | 4/1958 | Abs | 33/313 |
| 3,992,955 | 11/1976 | Evans | 74/5.1 |
| 4,236,414 | 12/1980 | Rodgers | 33/318 |
| 4,322,984 | 4/1982 | Lasher et al. | 74/51 |
| 4,389,792 | 6/1983 | Fuchs | 33/304 |
| 4,432,078 | 2/1984 | Silverman | 367/37 |

OTHER PUBLICATIONS

"Magnetic Single Shot Survey Instrument" *Scientific Drilling Control,* (no date).

"Mechanical Drift Indicator", Eastman Whipstock Publication, (no date).

*Primary Examiner*—Willis Little

*Attorney, Agent, or Firm*—Alan J. Atkinson

[57] ABSTRACT

An apparatus and method for preventing damage to the mechanical components of a borehole inclinometer is disclosed. The inclinometer uses a freely suspended pendulum to align with the vertical at a selected position in the borehole. A compass connected to the pendulum rotates to an orientation defined by the earth's magnetic field. To protect the components which suspend the pendulum, the pendulum is clamped between a timer and a lens as the inclinometer is lowered into the borehole. At a selected time, the pendulum is unclamped and is permitted to reach an equilibrium, measuring position. After a selected interval, the timer urges the pendulum against the lens to clamp the pendulum. The inclinometer is raised from the wellbore, and the orientation of the pendulum relative to the lens is observed to determine the azimuth and inclination of the borehole.

14 Claims, 5 Drawing Figures

FIG.1
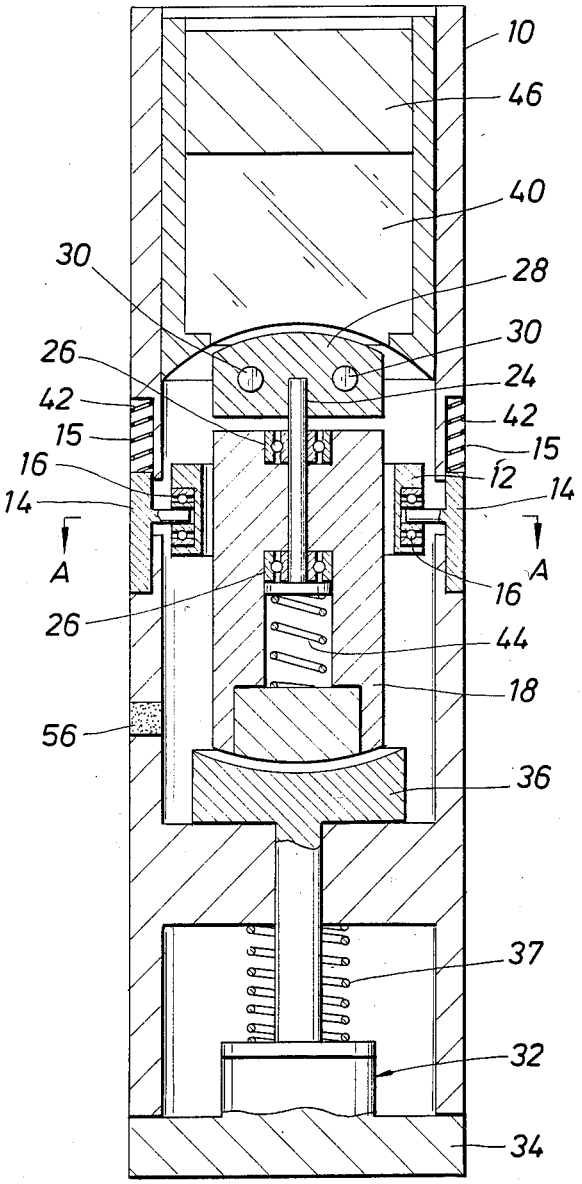
FIG.3
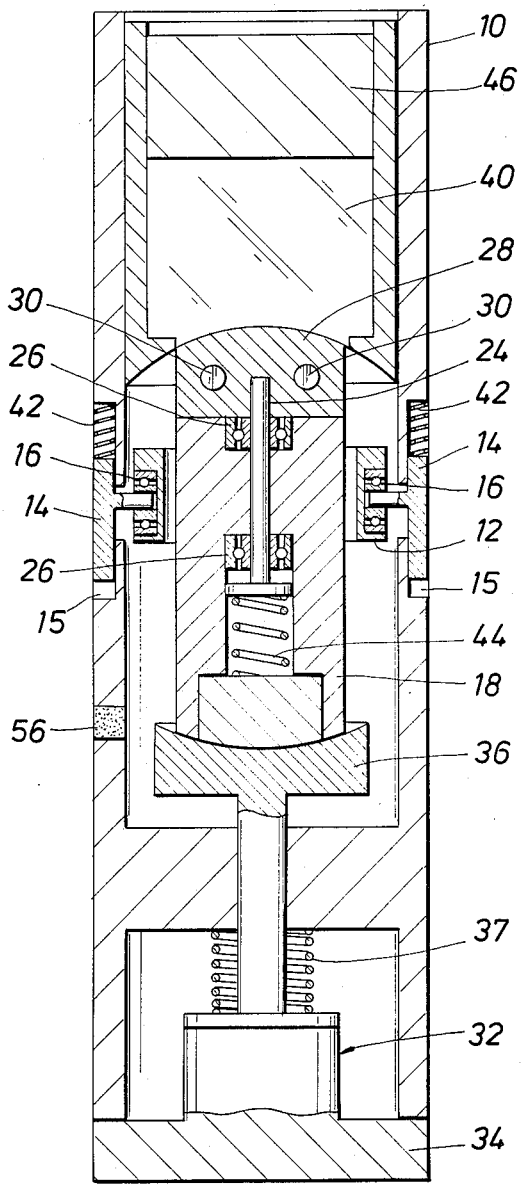
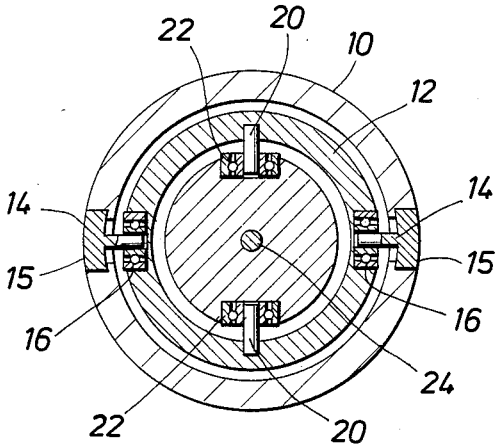
FIG. 2

MAGNETIC SINGLE SHOT INCLINOMETER

FIELD OF THE INVENTION

The present invention relates to a borehole inclinometer apparatus and method for measuring the inclination and azimuth of a borehole. More particularly, the invention prevents damage to the mechanical components of a borehole inclinometer by clamping the components as the inclinometer is transported in a borehole.

BACKGROUND OF THE INVENTION

Borehole inclinometer tools are frequently used in drilling operations to record the inclination and azimuth of a wellbore section. The location of the wellbore and its compass heading can be determined during drilling operations by periodically measuring the inclination and azimuth of the bottom of the borehole. Such measurements may be taken at 500 feet intervals in a substantially vertical wellbore and may be taken every 30 to 50 feet in a highly deviated well.

A number of tools have been developed to record the inclination and azimuth of a wellbore. U.S. Pat. No. 1,786,184 to Woodmansee discloses a wellbore tool having a cage which is rotatable about a vertical axis defined by two trunnions. A pendulous body supported by an inner frame pivots about a horizontal axis defined by two pintles. The pendulous body has a longitudinal axis which is aligned with vertical. The lower end of the pendulous body moves along an arc with a center defined by the horizontal axis through the pintles. As the longitudinal axis of the tool is displaced from a vertical orientation, the pendulous body remains in a vertical position as the center of mass of the pendulous body pivots about the pintles and causes the cage to rotate about the vertical trunnions. During drilling operations, the tool is lowered into the wellbore and a steel ball is dropped into the drilling mud to trigger a mechanical latch. The latch lowers the pendulous body into contact with a saddle until a braking disk contacts the lower end of the cage. The inclination of the tool is determined by measuring the angle between the longitudinal axis of the pendulous body and the longitudinal axis of the tool. The azimuth of the tool is recorded by the position of a compass needle which is mechanically locked following contact between the pendulous body and the saddle.

The tool disclosed in U.S. Pat. No. 2,770,887 to Barnett et al. uses a pendulous indicator assembly which is mounted above the upper end of a stem. A marking tip is connected to the upper portion of the indicator assembly. The stem is spring loaded at its lower end to cushion the weight of the indicating assembly. As the longitudinal axis of the tool is displaced from the vertical, the indicator assembly pivots about the stem so that the marking head points vertically upward. Concurrently, a magnet rotatably orients the marking head to indicate the azimuth of the tool. At a predetermined time, a timer actuates a mechanism to lower a metal or paper marking chart into contact with the marking head. The chart is then withdrawn from contact with the marking head to prevent damage to the chart as the tool is removed from the borehole. U.S. Pat. No. 2,770,887 discloses another embodiment having a marking chart supported on the convex surface of a pendulous, inner gimbal. The inner gimbal is pivotably connected to an outer gimbal which is attached to the tool along an axis defined by two pivots. The chart is marked by lowering an indicating head into contact with the chart. The indicating head is then withdrawn from contact with the chart as previously described.

U.S. Pat. No. 2,879,443 to Abs, a marking chart is set in the concave surface of a compass head which rotates about a pivot. A marking pin is located at the lower end of a pendulum suspended by a modified gimbal. To mark the chart, a timer mechanism raises the compass head until the marking pin penetrates the chart. The timer then lowers the compass head to prevent damage to the chart and to the pendulum.

To increase the accuracy of the inclinometer tools such as those discussed above, inclinometer tools typically use delicate suspension systems such as gimbals mounted on bearings to support a pendulous marking head. However, the delicate suspension systems can be easily damaged by impact shocks and vibrations as the tools are lowered into and retrieved from the borehole. Moreover, severe damage to the tool can occur due to careless handling on the floor of a drilling rig. Damage to the inclinometer tools may increase the possibility of errors in the measurements and may ultimately render the tools inoperable.

Another inclinometer tool not discussed above uses a downhole camera to photograph various sensors in the tool which indicate the inclination and azimuth of the borehole. After the tool is raised to the surface by tripping out the drill pipe or be reeling in a wireline, the film is removed from the tool and is developed. Although the film furnishes a permanent record of the measurements, this tool is not useful in boreholes with excessive temperatures which may damage or destroy the film.

Accordingly, a need exists for an inclinometer tool which accurately measures the inclination and azimuth of a borehole while resisting damage to delicate components of the tool. The tool should be operable in high temperatures and pressures and should be efficiently sealed from the operating environment.

SUMMARY OF THE INVENTION

The present invention provides an apparatus and method for preventing damage to the components of a borehole inclinometer by clamping certain components of the inclinometer as it is transported in a borehole. In a preferred embodiment of the invention, a lens having a concave surface is connected to a housing. A pendulous support has an upper convex surface in contact with the concave surface of the lens. The lower surface of the pendulous support contacts the concave surface of an actuator connected to the housing. A compass is connected to the support for rotating the support about its longitudinal axis.

The actuator can be manipulated to lower the support from contact with said lens and to raise the support into contact with the lens. As the actuator lowers the support, a spring and a pivot located between the actuator and the support cooperate to urge the support away from the actuator. The support can then pivotably move about the pivot due to the force of gravity and can rotatably move about its longitudinal axis due to the torque exerted by the earth's magnetic field on the compass. After the support has reached an equilibrium position and is neither pivoting nor rotating, the actuator raises the support into contact with the lens, the actuator contacts the support, and the apparatus is retrieved from the borehole.

In another embodiment of the present invention, a pendulous support is in sliding engagement with the housing. The convex surface of a compass rotatably connected to the support contacts the concave surface of a lens which is connected to the housing. A first surface of the support also contacts the compass to urge the compass against the housing. An actuator in contact with a second surface of the support is withdrawn from such contact to permit a second spring to urge the support and compass away from the lens and to permit a first spring to urge the compass away from contact with the support. The support then aligns its longitudinal axis with the vertical, the compass rotates to measure the azimuth of the well, and the actuator reengages the support until the support contacts the compass and the compass contacts the lens. The apparatus is then retrieved from the borehole after the support and compass have been clamped between the actuator and the lens.

BRIEF DESCRIPTION OF THE DRAWINGS

FIG. 1 illustrates a longitudinal sectional view of the present invention.

FIG. 2 illustrates a sectional view of the invention taken along line A—A.

FIG. 3 illustrates a longitudinal sectional view of the invention in its normal, clamped position.

DESCRIPTION OF THE PREFERRED EMBODIMENT

Figure 4:
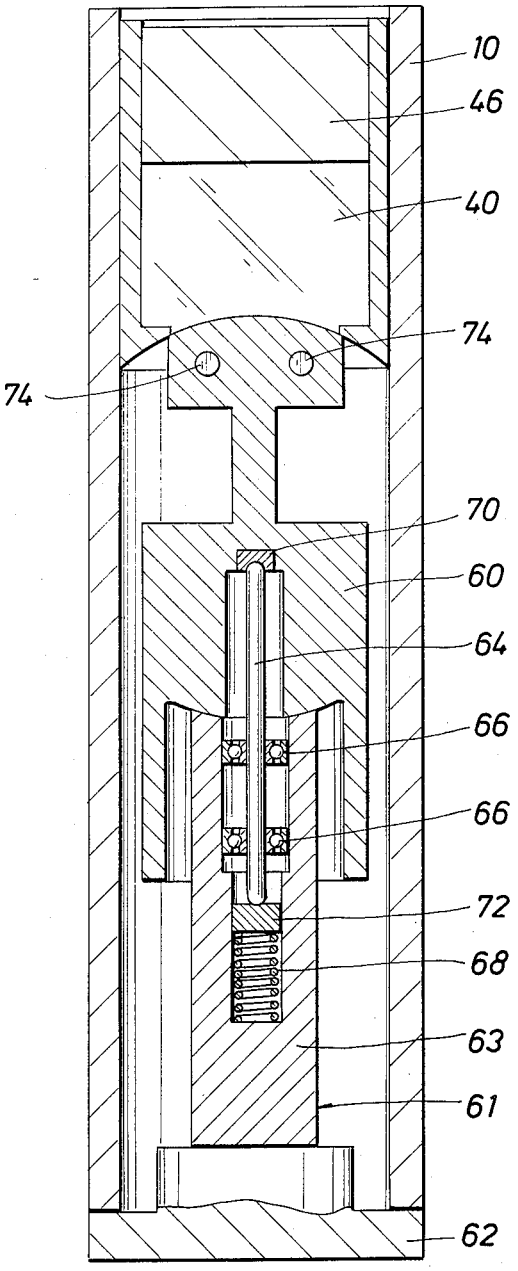
FIG. 4 illustrates a sectional view of a pendulous support and attached compass which is suspended by a shaft.

FIG. 1 shows a magnetic single shot inclinometer according to the present invention. Outer housing 10 is shown as an elongated cylinder having a longitudinal axis through the center of the cylinder. Housing 10 is positioned in a pressure vessel (not shown) which protects housing 10 from the pressure of the borehole. Outer gimbal 12 is pivotably connected to housing 10 by shafts 14 which permit outer gimbal 12 to pivot about an axis which is orthogonal to the longitudinal axis of housing 10. Each shaft 14 is positioned to reciprocate within slide way 15 as will be described more thoroughly below. Friction between outer gimbal 12 and shafts 14 is reduced by bearings 16. As shown in FIG. 2, inner gimbal 18 is connected to outer gimbal 12 by shafts 20. Friction between inner gimbal 18 and shafts 20 is reduced by bearings 22. Shafts 20 define an axis which is orthogonal to the axis defined by shafts 14. The axes of shafts 14 and 20 preferably intersect at a point along the longitudinal axis of housing 10.

The center of mass of inner gimbal 18 is located at a selected distance from the pivotal axis defined by shafts 20. As the force exerted by gravity causes the center of mass of inner gimbal 18 to seek the position of least potential energy, a line through the center of mass of inner gimbal 18 delineates an axis which will be defined as the "center axis" of inner gimbal 18. The center axis is orthogonal to the axis defined by shafts 20 and preferably intersects the longitudinal axis of housing 10. Provided that no forces other than gravity act on inner gimbal 18, the center axis of inner gimbal 18 will be aligned with the local vertical due to the mechanical combination of outer gimbal 12 and inner gimbal 18. As is well-known in the art, the movement of inner gimbal 18 is limited within a cone defined by the half angle of a selected inclination angle between the local vertical and the longitudinal axis of housing 10.

Referring to FIG. 1, elongated compass shaft 24 is rotatable about an axis which is preferably coincident with the center axis of inner gimbal 18. Compass shaft 24 is retained in inner gimbal 18 by bearings 26 which reduce friction between compass shaft 24 and inner gimbal 18 as compass shaft 24 rotates. As illustrated, the upper end of compass shaft 24 is connected to compass head 28 which generally lies in a plane perpendicular to the center axis of inner gimbal 18. The lower surface of compass head 28 is illustrated as a flat surface parallel with the upper surface of inner gimbal 18. The upper surface of compass head 28 is generally convex in the shape of a spherical segment. The radius of the sphere is defined by a centerpoint which is preferably coincident with the intersection of the axes defined by shafts 14 and 20. Compass head 28 contains bar magnets 30 which are preferably made of Samarium cobalt or other permanent magnet materials such as Alnico V or Alnico VIII. As is well-known in the art, the poles of magnets 30 are diametrically opposed about the axis of compass shaft 24. As magnets 30 interact with the earth's magnetic field, compass head 28 will rotate about compass shaft 24, due to a couple produced by the horizontal component of the earth's magnetic field acting on magnets 30, until magnets 30 are located in a position of least magnetic potential energy relative to the earth's magnetic field.

The spherical surface of compass head 28 is inscribed with a series of concentric circles (not shown) having a center which is intersected by the axis of compass shaft 24. The concentric circles are positioned to indicate increments of tilt angle of the axis of compass shaft 24 relative to the longitudinal axis of housing 10. Compass head 28 is also inscribed with a compass heading.

Referring to FIG. 3, actuator 32 is connected to housing 10. Actuator 32 comprises timer 34, plunger 36, and plunger spring 37. As illustrated, the upper surface of plunger 36 is urged by timer 34 into contact with the lower surface of inner gimbal 18. Timer 34 releases plunger 36 at a desired time, and spring 37 urges plunger 36 away from contact with inner gimbal 18. Following a selected interval of time, timer 34 reengages plunger 36 to urge plunger 36 into contact with the lower surface of inner gimbal 18. Because plunger 36 generally moves linearly along a line parallel with the longitudinal axis of housing 10 as plunger 36 contacts inner gimbal 18, and because the center axis of inner gimbal 18 may not be parallel to the longitudinal axis of housing 10, the lower surface of inner gimbal 18 is preferably convex in shape so that the distance between plunger 36 and inner gimbal 18 remains constant regardless of the inclination of housing 10 from the vertical. The radius of the lower, convex surface of inner gimbal is defined by a centerpoint which preferably coincides with the intersection of the axes through shafts 14 and 20. The upper end of plunger 36 is illustrated as being concave in shape with a curvature inversely corresponding to the lower convex surface of inner gimbal 18. Alternatively, the upper end of plunger 36 could be shaped as a concave cone, cylinder, or other shape.

Lens 40 is illustrated as being connected to housing 10 above compass head 28. Lens 40 has a concave surface of a curvature inversely corresponding to the convex surface of compass head 28. Therefore, the distance between lens 40 and the upper surface of compass head 28 does not vary as housing 10 is inclined at an angle from the vertical. Preferably, the longitudinal axis of housing 10 intersects the center of the concave, spherical surface of lens 40. A reticle (not shown) marks the reference point of such intersection so that when the longitudinal axis of housing 10 is vertical, the center of the reticle is aligned with the center axis of inner gimbal 18 and the centerpoint of compass head 28.

As illustrated in FIG. 3, plunger 36 is in contact with the lower surface of inner gimbal 18. The concave surface of lens 40 is in contact with the convex surface of compass head 28, and the upper surface of inner gimbal 18 is in contact with the lower surface of compass head 28. In this position, compass head 28 and inner gimbal 18 are clamped between lens 40 and plunger 36 to prevent compass head 28 from rotating about compass shaft and to prevent inner gimbal 18 from moving relative to housing 10.

The present invention is used by lowering housing 10 to a desired location in the wellbore. Preferably, compass head 28 and inner gimbal 18 are clamped as shown in FIG. 3 to reduce the possibility of damage to the components as the invention is lowered into the borehole. In particular, the clamping of compass head 28 and inner gimbal 18 prevents damage to bearings 16 and 22 used to support outer gimbal 12 and inner gimbal 18 respectively. When housing 10 reaches the desired location in the borehole and is stationary, drilling operations are temporarily suspended. Pre-set timer 34 and spring 37 then operate to withdraw plunger 36 from contact with the lower surface of inner gimbal 18. Coincidentally, spring 42 urges outer gimbal 12, inner gimbal 18, and compass head 28 away from lens 40, and spring 44 urges compass head 28 away from contact with inner gimbal 18. In the resulting position which is shown in FIG. 1, compass head 28 is rotatably suspended above inner gimbal 18 on compass shaft 24, and inner gimbal 18 and outer gimbal 12 cooperate to align the center axis of inner gimbal 18 with the vertical. After a selected period of time which permits compass head 28 to magnetically orient and which permits inner gimbal 18 to align with the vertical, timer 34 urges plunger 36 into contact with inner gimbal 18.

As plunger 36 urges inner gimbal 18 toward lens 40, the force exerted by plunger 36 on inner gimbal 18 is transmitted through bearings 22 and shafts 20 to outer gimbal 12 and through bearings 16 and shafts 14 to act against springs 42. Slide ways 15 constrain the movement of each shaft 14 in a line parallel to the longitudinal axis of housing 10. The force compresses springs 42 and permits outer gimbal 12, inner gimbal 18, and compass head 28 to move toward lens 40 until the upper surface of compass head 28 contacts lens 40. Following such contact, continued movement of inner gimbal 18 and outer gimbal 12 toward lens 40 will compress spring 44 until the upper surface of inner gimbal 18 contacts compass head 28. Inner gimbal 18 and compass head 28 are then clamped between plunger 36 and lens 40 as shown in FIG. 3.

To fully clamp inner gimbal 18 and compass head 28, the force exerted by plunger 36 on inner gimbal 18 must exceed the resultant spring force exerted by springs 42 and by spring 44 by the product of the residual force. The residual force is calculated by multiplying the averaged length of the inner gimbal 18 and compass head 28 times the average coefficient of friction between inner gimbal 18 and plunger 36, and compass head 28 and lens 40 (which defines a resultant clamping torque exceeding the pendulosity of inner gimbal, compass shaft 37, compass head 28), times the peak accelerations the tool experiences in a direction perpendicular to shaft 24. This latter product defines the maximum disturbing torque which acts on the clamped tool. If this resultant clamping torque is smaller than the disturbing torque, the tool reading will be altered as the tool is withdrawn from the wellbore.

Once compass head 28 and inner gimbal 18 have been clamped, housing 10 is raised out of the wellbore. Housing 10 is removed from the pressure vessel, and lens holder 46 is removed from housing 10 to view the upper surface of compass head 28. Optical correction of upper lens 40 is unnecessary because compass head 28 is in contact with lens 40. The azimuth and inclination readings can be made visually by an operator, or a photograph of the position of the compass head through the lens can be taken for later analysis with mechanical or optical aids. The invention is prepared for the next measurement by reattaching lens holder 46 to housing 10, by setting timer 34, and by positioning housing 10 in the pressure vessel.

Housing 10 is designed to prevent particulate contamination of bearings 16 and 22. O-ring seals (not shown) may be used to isolate inner gimbal 18 and outer gimbal 12 from the wellbore environment. Porous plug 56, which may be formed of sintered metal, is located to prevent a differential pressure from developing between the inside of housing 10 and the pressure vessel which surrounds housing 10.

FIG. 4 illustrates a different embodiment of the present invention. In particular, FIG. 4 illustrates a simplified mechanism for suspending a pendulous support. Pendulous support 60 is similar to inner gimbal 18 and has an upper, convex surface in contact with lens 40 as previously described for compass head 28. Actuator 61 comprises timer 62 and plunger 63 as previously described. Shaft 64, bearings 66, and springs 68 are located between support 60 and plunger 63. The upper end of shaft 64 acts as a pivot as more thoroughly described below. Preferably, shaft 64 has an axis which is coincident with the longitudinal axis of housing 10 and is retained in plunger 64 with bearings 66. Spring 68 is positioned between shaft 64 and plunger 63. Endstones 70 and 72 are located at either end of shaft 64 to furnish a hard, wear surface. Plunger 63 is in contact with the lower surface of support 60. Preferably, the lower surface of support 60 is convex in the shape of a spherical segment defined by a radius with a centerpoint at the upper pivot end of shaft 64. The contacting surface of plunger 63 is preferably concave with a curvature inversely corresponding to the lower, convex surface of support 60.

In the normal position, support 60 is clamped between plunger 63 and lens 40. When housing 10 has been lowered to the desired location in the borehole and drilling operations have been suspended, plunger 63 withdraws from contact with the lower surface of support 60 until support 60 rests on shaft 64. Plunger 63 continues to withdraw until the upper surface of support 60 is withdrawn from contact with lens 40. Support 60 preferably has a center of mass which is positioned at a point lower than the point where endstone 70 contacts the upper pivot end of shaft 64. As the longitudinal axis of housing 10 is displaced from the vertical, support 60 will pivot about the upper end of shaft 64 so that the center axis of support 60 remains vertical. Compass 74 connected to support 60 will cause support 60 to rotate about its center axis until the upper surface of support 60 is magnetically oriented.

After support 60 has rotated to indicate the azimuth heading of housing 10 and has pivoted about the upper end of shaft 64 to indicate the inclination of housing 10, timer 62 engages plunger 63 to move spring 68 and shaft 64 to urge the upper surface of support 60 toward lens 40. As the upper surface of support 60 contacts lens 40, further movement of plunger 63 toward lens 40 will cause spring 68 to compress until the upper surface of plunger 63 contacts the lower surface of support 60. At such time support 60 is clamped between plunger 63 and lens 40 and the axial force acting on shaft 64 is limited to the force exerted by compressed spring 68. Housing 10 then can be raised out of the wellbore and lens holder 46 can be removed as previously indicated.

Figure 5:
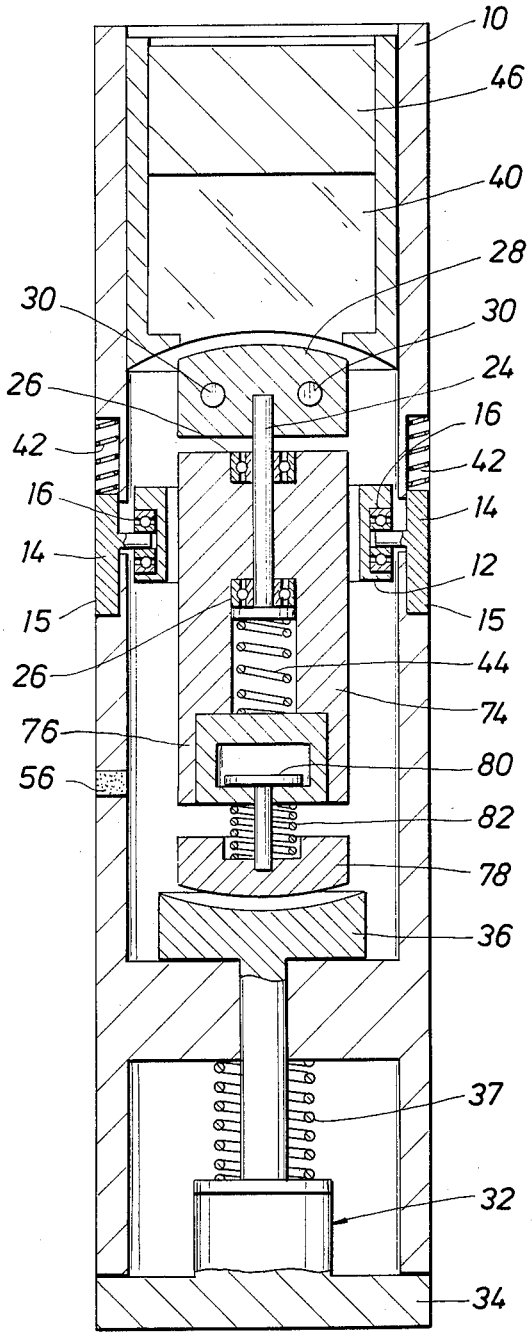
FIG. 5 illustrates a modified pendulous inner gimbal having a variable center of mass.

FIG. 5 shows another embodiment of the present invention. As illustrated, inner gimbal 74 replaces inner gimbal 18 in FIGS. 1–3. Inner gimbal 74 comprises body 76, cap 78, shaft 80, and spring 82. Spring 82 urges cap 78 away from body 76, and shaft 80 is configured to limit the amount of separation between cap 78 and body 76. In operation, plunger 36 urges cap 78 upward against spring 82 until cap 78 contacts body 76. Thereafter, outer gimbal 12, compass head 28, and springs 42 and 44 will operate as previously described.

By varying the pendulosity of inner gimbal 74, the embodiment of the invention shown in FIG. 5 reduces errors created by clamping compass head 28 against lens 40. As used herein, pendulosity is defined as the product of the mass of inner gimbal 18 (together with attached compass shaft 24, compass head 28, and spring 44) times the displacement of the center of mass from the axis defined by shaft 20. By extending cap 78 away from the axis defined by shaft 20, the pendulosity of inner gimbal 74 is increased while the inclination of housing 10 from the vertical is being measured. The pendulosity is reduced as plunger 36 urges cap 78 toward body 76 and compass head 28 is correspondingly urged against lens 40. A decrease in pendulosity as compass head 28 is urged against lens 40 reduces the possibility of an erroneous reading because it reduces the disturbing torque created by accelerations acting on the center of mass of inner gimbal 74 which are transverse to the longitudinal axis of housing 10.

Many improvements and modifications can be made to the present invention without departing from the scope of the invention. For example, the timer and plunger could be positioned to move the lens or lens holder into contact with the gimbals and attached compass head. In such an embodiment, a spring could be located between the outer gimbal and the housing to counteract the force imposed by the plunger. A portion of the housing or a special stop could be used to contact the lower end of the inner gimbal as the lens and compass head urged the lower gimbal down. In other embodiments of the present invention, the location of the compass head and lens could be varied. For example, the lens could be located at the lower end of the housing and the compass head could be located below the inner gimbal.

The present invention furnishes a unique apparatus and method for protecting the components of a borehole inclinometer. By clamping the measuring components, the possibility of damage to the components is reduced and the useful life of the inclinometer is extended. The unique configuration of the invention also permits other practical advantages to be realized. For example, by rigidly clamping the measuring components of the inclinometer to limit the force exerted on delicate suspension components, the entire inclinometer can be downsized to fit in smaller apertures than heretofore possible. In addition, the location of the lens not only furnishes a structural component of the invention but also permits readings of the azimuth and inclination of the borehole to be taken without exposing the components of the inclinometer to the environment.

What is claimed is:

1. An apparatus for measuring the inclination and azimuth of a borehole, comprising:

a housing;

a lens connected to said housing and having a concave surface;

a pendulous support having a lower surface, an upper convex surface in contact with the concave surface of said lens, and a longitudinal axis which intersects the upper, convex surface of said support;

a compass connected to said support so that the magnetic poles of said compass are diametrically opposed about the longitudinal axis of said support;

an actuator connected to said housing and having a surface in contact with the lower surface of said support, wherein said actuator can be manipulated to lower said support from contact with said lens and to raise said support into contact with said lens;

a pivot in contact with the lower surface of said support at a point which intersects the longitudinal axis of said support; and a spring located between said pivot and said actuator for urging said pivot and said support away from contact with said actuator as said actuator lowers said support from contact with said lens, thereby permitting said compass to rotate said support about its longitudinal axis and permitting pivotal movement of said support about said pivot.

2. An apparatus as described in claim 1, further comprising a bearing located between said pivot and said actuator for permitting rotation of said pivot.

3. An apparatus as described in claim 1, wherein the actuator surface in contact with said support is generally shaped as a concave segment of a sphere and the lower surface of said support is generally shaped as a convex segment of a sphere having the same radius as the radius which defines the concave surface of said actuator.

4. An apparatus as described in claim 1, further comprising a cap, located between and in contact with the lower surface of said support and the concave surface of said actuator, and comprising a second spring positioned between said cap and said support for urging said cap away from said support as said support is urged away from said actuator.

5. An apparatus as described in claim 1, wherein said lens is slidably engaged with said housing, said actuator can be manipulated to move said lens into contact with the upper surface of said support, and said spring is located between said pivot and said housing.

6. An apparatus for measuring the inclination and azimuth of a borehole, comprising:

a housing;

a lens connected to said housing and having a concave surface;

a compass having a convex surface in contact with the concave surface of said lens;

a pendulous support positioned in sliding engagement with said housing and having a first surface in contact with said compass and having a second surface;

a first spring connected between said support and said compass for urging said compass to a selected distance away from the first surface of said support;

a second spring positioned between said support and said housing for urging said support and compass away from said lens; and an actuator having a surface in contact with the second surface of said support for holding said compass in contact between said support and said lens, wherein said actuator can be withdrawn from contact with the second surface of said support to permit said second spring to urge said compass away from contact with said lens and to permit said first spring to urge said compass away from contact with the first surface of said support.

7. An apparatus as recited in claim 6, wherein said lens is located above said compass and said compass is located above said support.

8. An apparatus as recited in claim 6, wherein the actuator surface in contact with said support is generally shaped as a concave segment of a sphere and the second surface of said support is generally shaped as a convex segment of a sphere having the same radius as the radius which defines the concave surface of said actuator.

9. An apparatus as described in claim 6, wherein said lens is slidably engaged with said housing, said actuator can be manipulated to move said lens into contact with the upper surface of said compass until the lower surface of said support contacts said housing, and said second spring is positioned between said support and said housing for urging the lower end of said support away from said housing.

10. An apparatus for measuring the inclination and azimuth of a borehole, comprising:

a housing having an axis which is parallel to the axis of a selected portion of the borehole;

a lens connected to the upper end of said housing and having a concave surface;

a pendulous support positioned in sliding engagement with said housing and having an upper surface, a lower surface, and a longitudinal axis aligned with the vertical;

a first spring connected to the upper surface of said support;

a compass rotatably suspended by said first spring above the upper surface of said support and having a convex surface of a curvature inversely corresponding to the concave surface of said lens;

a second spring positioned between said support and said housing for urging said support and said compass away from said lens; and an actuator, which can be manipulated to contact the lower surface of said support, for urging said support against said second spring until the convex surface of said compass contacts the concave surface of said lens and for urging said support against said first spring until the upper surface of said support contacts said compass.

11. An apparatus for measuring the inclination and azimuth of a borehole, comprising:

an elongated housing having a closed end and having a longitudinal axis which is parallel to the centerline of a selected portion of the borehole;

a pendulous support having an upper surface, a lower surface adjacent the closed end of said housing, and being positioned in sliding engagement along the longitudinal axis of said housing;

a first spring connected to the upper surface of said support;

a compass rotatably suspended by said first spring above the upper surface of said support and having an upper, convex surface;

a second spring positioned between said support and said housing for urging said support away from the closed end of said housing;

a lens positioned in sliding engagement with said housing and having a concave surface adjacent the convex surface of said compass of a curvature inversely corresponding to the convex surface of said compass; and an actuator connected to said housing for urging said lens against said compass and against said first spring, until said compass contacts the upper surface of said support, and for urging said lens, compass, and support against said second spring until the lower end of said support contacts the closed end of said housing.

12. An apparatus for determining the inclination and azimuth of a borehole, comprising:

an elongated housing having a longitudinal axis which is parallel to the axis of a selected portion of the borehole;

a lens connected to said housing and having a concave surface;

an outer gimbal positioned in sliding engagement along the longitudinal axis of said housing and being pivotable about an axis which is perpendicular to the longitudinal axis of said housing;

a pendulous, inner gimbal having an upper surface and a lower surface and being pivotably connected to said outer gimbal about an axis which is perpendicular to the pivotal axis of said outer gimbal;

a first spring connected to the upper surface of said inner gimbal;

a compass rotatably suspended by said first spring above the upper surface of said inner gimbal and having an upper, convex surface of a curvature inversely corresponding to the concave surface of said lens;

a second spring positioned between said support and said housing for urging said support and compass away from said lens; and an actuator, connected to said housing, for urging said inner gimbal and outer gimbal against said second spring, until the convex surface of said compass contacts the concave surface of said lens, and for urging said inner gimbal against said first spring until the upper surface of said inner gimbal contacts said compass.

13. An apparatus for measuring the inclination and azimuth of a borehole, comprising:

a housing;

a lens connected to said housing and having a concave surface;

a compass having a convex surface in contact with the concave surface of said lens;

a pendulous support positioned in sliding engagement with said housing and having a first surface in contact with said compass and having a second surface;

a first spring connected between said compass and the first surface of said support for urging said compass to a selected distance away from said support;

a second spring positioned between said support and said housing for urging said support and compass away from said lens;

a cap located in contact with the lower surface of said support;

a third spring positioned between said cap and the lower surface of said support for urging said cap away from said support; and an actuator having a surface in contact with said cap for holding said compass and said support in contact between said cap and said lens, wherein said actuator can be withdrawn from contact with said cap to permit said third spring to urge said cap away from said support, to permit said second spring to urge said compass away from contact with said lens, and to permit said first spring to urge said compass away from contact with said support.

14. A method for preventing damage to the components of a borehole inclinometer, comprising the steps of:

clamping a pendulous support between an actuator and a lens connected to a housing;

a lowering said housing to a selected position in a borehole;

withdrawing said actuator from contact with said support until said support no longer contacts said actuator or said lens and is supsended in a measuring position;

clamping said support between said actuator and said lens after said support has reached an equilibrium position;

raising said housing from the wellbore; and observing the orientation of said support relative to said lens.

* * * * *